United States Patent [19]

Tsujihiro

[11] Patent Number: 5,077,170

[45] Date of Patent: Dec. 31, 1991

[54] TONER COMPOSITION

[75] Inventor: Masami Tsujihiro, Katano, Japan

[73] Assignee: Mita Industrial Co., Ltd., Osaka, Japan

[21] Appl. No.: 443,579

[22] Filed: Nov. 30, 1989

[30] Foreign Application Priority Data

Nov. 30, 1988 [JP] Japan ..... 63-303083

[51] Int. Cl.[5] ..... G03G 9/00; G03G 5/00

[52] U.S. Cl. ..... 430/110; 430/109; 430/111; 430/137

[58] Field of Search ..... 430/109, 110, 111, 137

[56] References Cited

U.S. PATENT DOCUMENTS 4,395,485 6/1983 Kashiwagi et al. ..... 430/110 X
4,933,253 6/1990 Aoki et al. ..... 430/110
4,949,127 8/1990 Matsuda et al. ..... 430/122 X

FOREIGN PATENT DOCUMENTS 0186851 9/1985 Japan ..... 430/111
0186875 9/1985 Japan ..... 430/111

*Primary Examiner*—Marion E. McCamish
*Assistant Examiner*—Stephen Crossan
*Attorney, Agent, or Firm*—Sherman and Shalloway

[57] ABSTRACT

Disclosed is a toner composition comprising a toner having electroscopic and fixing properties and fine particles of an acrylic polymer, wherein the fine particles of the acrylic polymer are hydrophobic spherical particles having a particle size of 0.05 to 1 μm, which are obtained by dispersion polymerization of an acrylic monomer in a non-aqueous medium.

This toner composition is capable of maintaining good developing property and cleaning property for a long time even in a high-temperature and high-humidity condition and has good flowability and blocking resistance.

These properties are further improved by incorporating fine particles of silica, especially hydrophobic silica, into this toner composition.

9 Claims, No Drawings

TONER COMPOSITION

BACKGROUND OF THE INVENTION (1)Field of the Invention

The present invention relates to a toner composition for developing an electrostatically charged image. More particularly, the patent invention relates to a toner composition in which the developing property, flowability and cleaning property are not influenced by environmental changes but can be maintained at high levels for a long time.

(2) Description of the Prior Art

In a copying machine or the like utilizing the electrophotographic process, various powdery toners formed by dispersing additives such as a colorant into a binder resin have been used for visualizing an electrostatically charged latent image formed on a photosensitive material comprising a photosensitive layer containing an inorganic or organic photoconductive substance according to the dry development method.

In this electrophotographic process, an electrostatic latent image formed on the above-mentioned photosensitive material by the charging and light exposure is developed by the above-mentioned toner, and the formed toner image corresponding to the electrostatic latent image is transferred onto a support such as a transfer paper and simultaneously, the toner image is fixed to the support by fixing means such as a heating roller or pressing roller to obtain a print. After the toner image has been transferred onto the support, the toner left on the photosensitive material is scraped out by a cleaning blade to remove the toner left on the photosensitive material and effect the cleaning.

In order to form good images in the above-mentioned system, the toner is required to have such a good charging property and a good developing property as not causing fogging or scattering of the toner and furthermore, at the cleaning step conducted after the transfer of the image, the toner is required to have such a property that the toner should not be left on the photosensitive material. Thus, the toner is required to have various characteristics at the respective steps.

Accordingly, a method for improving the charge stability and cleaning property by using a toner composition formed by adding a fine powder of an acrylic polymer to a toner has recently been proposed by Japanese Unexamined Patent Publication No. 60-186851, etc.

Furthermore, Japanese Unexamined Patent Publication No. 60-186854 proposes a toner composition comprising a fine powder of an acrylic polymer obtained by soap-free polymerization as a toner excellent in the resistance to environmental changes.

When a fine powder of an acrylic polymer is prepared by soap-free polymerization, particles having a relatively low content of a hydrophilic substance or a hydrophilic group can be synthesized, but since a water-soluble initiator is used for the polymerization, fragments of the initiator are left on the surfaces of the particles and no sufficient hydrophobicity is attained. Accordingly, if an image is formed by using a toner composition obtained by incorporating fine particles obtained by the soap-free polymerization into toner particles, an image having an excellent image can be formed at the initial stage and in a good environment, but with the lapse of time or in a high-humidity condition, insufficient cleaning, fogging of the image and reduction of the image density are caused, and it often happens that the image quality is drastically degraded. A method for dropping and supplying a toner to a toner-stirring zone from a hopper by rotation of a sponge roller or the like is often adopted. If a toner composition comprising fine particles of an acrylic polymer is used in this method, it often happens that the toner composition does not fall from the supplying roller, presumably because of a poor flowability, and in an extreme case, it becomes impossible to supply the toner composition. In a process unit generally adopted in recent years for attaining a maintenance-free effect (a developing zone, a photosensitive material, a cleaning zone and the like are integrated and the unit is discarded when the developer or photosensitive material becomes ineffective), a developer is charged in a narrow space of the developing zone, and if the developer is stored for a long time or allowed to stand still in the unused state, blocking is often caused in the toner by the weight thereof or changes of the temperature and humidity. In the case where the toner is supplied into a developing device from a conventional toner cartridge or toner holder, even if blocking is caused, the toner can be disintegrated by imparting a vibration or shock to the toner. However, it is not permissible to shake the process unit or give a shock to the process unit, because other mechanisms or members are adversely influenced. Therefore, the toner composition is required to have further improved moisture resistance and blocking resistance.

SUMMARY OF THE INVENTION

The present invention has been completed under the above-mentioned background, and it is therefore a primary object of the present invention to provide a toner composition capable of maintaining good developing property and cleaning property for a long time even under a high-humidity condition.

Another object of the present invention is to provide a toner composition having a good flowability without blocking and showing a good transportability from a hopper and a good stability with the lapse of time in a process unit.

More specifically, in accordance with one aspect of the present invention, there is provided a toner composition comprising a toner having electroscopic and fixing properties and fine particles of an acrylic polymer, wherein the fine particles of the acrylic polymer are hydrophobic spherical particles having a particle size of 0.05 to 1 μm, which are obtained by dispersion polymerization of an acrylic monomer in a non-aqueous medium.

In accordance with another aspect of the present invention, there is provided a toner composition comprising a toner having electroscopic and fixing properties, fine particles of an acrylic polymer and fine particles of silica, wherein the fine particles of the acrylic polymer are hydrophobic spherical particles having a particles size of 0.05 to 1 μm, which are obtained by dispersion polymerization of an acrylic monomer in a non-aqueous medium.

In accordance with still another object of the present invention, there is provided a toner composition comprising a toner having electroscopic and fixing properties and fine particles of an acrylic polymer, wherein the fine particles of the acrylic polymer are hydrophobic spherical particles having a particle size of 0.05 to 1 μm, which are obtained by dispersion-polymerizing an acrylic acid ester or a methacrylic acid ester in a saturated hydrocarbon solvent in the presence of a synthetic rubber or natural rubber as a dispersion stabilizer and an oil-soluble radical polymerization initiator.

DETAILED DESCRIPTION OF THE PREFERRED EMBODIMENTS

One of the important features of the present invention is that a toner composition formed by incorporating and mixing fine particles of an acrylic polymer obtained by dispersion polymerization in a non-aqueous medium into toner particles should be used.

The fine particles of the acrylic polymer used in the present invention are obtained by carrying out the polymerization with stirring by using a polymerizable monomer, an oil-soluble initiator and a dispersion stabilizer in a saturated hydrocarbon which is a completely non-aqueous medium. Since the polymerization medium is a completely non-aqueous medium and an oil-soluble initiator is used, the hydrophobicity of the particles per se, especially the surfaces thereof, is highly improved. The formed particles are substantially spherical particles having a particle size of 0.05 to 1 μm, and these particles are added to toner particles and the mixture is blended and stirred by a dispersing apparatus, whereby the polymer particles are uniformly dispersed on the surfaces of the toner particles. Accordingly, the obtained toner composition has an improved charge stability (uniformity) and shows good developing characteristics, and the toner can be promptly removed from the photosensitive material at the cleaning step. Furthermore, since the composition per se is rendered hydrophobic by the fine polymer particles, the flowability and blocking resistance are highly improved and the transportability from the supplying roller is stabilized. Moreover, agglomeration of the toner (composition) can be prevented during long-period storage. Thus, a toner composition which is excellent in transportability and blocking resistance can be provided.

As the monomer constituting the fine particles of the acrylic polymer used in the present invention, there can be mentioned acrylic and methacrylic monomers such as acrylic acid, methyl acrylate, ethyl acrylate, n-butyl isobutyl acrylate, n-octyl acrylate, 2-ethylhexyl acrylate, dodecyl acrylate, stearyl acrylate, cyclohexyl acrylate, phenyl acrylate, 2-hydroxypropyl acrylate, diethylaminoethyl acrylate, acrylamide, acrylonitrile, methacrylic acid, methyl methacrylate, ethyl methacrylate, n-butyl methacrylate, isobutyl methacrylate, n-octyl methacrylate, 2-ethylhexyl methacrylate, dodecyl methacrylate, stearyl methacrylate, cyclohexyl methacrylate, phenyl methacrylate, 2-hydroxypropyl methacrylate and diethylaminoethyl methacrylate. These monomers can be used singly or in the form of a mixture of two or more of them.

Other vinyl polymerizable monomers can be used together with the above-mentioned acrylic or methacrylic monomer. For example, there can be mentioned styrene type monomers such as styrene, α-methylstyrene, o-methylstyrene, p-methylstyrene, p-methoxystyrene and p-chlorostyrene, carboxylic acids having an unsaturated double bond and alkyl esters thereof such as maleic acid, fumaric acid, crotonic acid, itaconic acid and alkyl esters thereof, olefin monomers such as ethylene, propylene and butadiene, and vinyl acetate, vinyl chloride, vinylidene chloride, vinylpyrrolidone and vinylnaphthalene.

As the dispersion medium which is a completely non-aqueous medium, there can be mentioned aliphatic hydrocarbons, especially aliphatic hydrocarbons having 5 to 10 carbon atoms, such as n-hexane, n-heptane and n-octane. These solvents are ideal solvents because they can dissolve or disperse the monomer therein but they cannot dissolve the formed polymer. As the dispersion stabilizer for stabilizing the particles, there can be mentioned synthetic rubber and natural rubber derivatives such as butadiene rubber, isobutyl-isoprene rubber, polyisobutyl and natural rubber, drying oil-modified alkyd resins, polymers of acrylic acid or methacrylic acid esters of aliphatic long-chain alcohols such as lauryl alcohol and 2-ethylhexyl alcohol, and polymethyl methacrylate having a poor solubility. These rubbers can be used singly or in the form of two or more of them. Furthermore, two or more of these rubbers can be used in the chemically bonded state.

As the polymerization initiator to be added together with the above-mentioned polymerizable monomer, an oil-soluble initiator is used. For example, there can be mentioned azo compounds such as azobisisobutyronitrile, and peroxide such as cumene hydroperoxide, t-butyl hydroperoxide, dicumyl peroxide, benzoyl peroxide and lauroyl peroxide.

In connection with the mixing ratios of the respective components, the completely non-aqueous solvent, polymerization initiator and dispersion stabilizer can be used in amounts appropriately selected from ranges of 100 to 2000 parts by weight, 0.1 to 10 parts by weight and 0.1 to 10 parts by weight, respectively, per 100 parts by weight of the polymerizable monomer.

The polymerizable composition comprising the above-mentioned monomer and initiator is dispersed together with the dispersion stabilizer into the solvent, and polymerization is carried out with stirring.

The polymerization conditions will now be described. It is preferred that the polymerization be carried out at a polymerization temperature of 50° to 100° C., especially 60° to 80° C. Stirring of the reaction mixture can be accomplished by known means, and gentle stirring as advancing the reaction homogeneously is preferred. In order to inhibit polymerization by oxygen, there can be adopted a method in which the polymerization is carried out while replacing the atmosphere of the reaction system by an inert gas such as nitrogen.

It is preferred that the fine particles of the acrylic polymer obtained by the above reaction should have a particle size of 0.05 to 2 μm, especially 0.1 to 1 μm. It also is preferred that the fine particles of the acrylic polymer be used in an amount of 0.01 to 1 part by weight, especially 0.05 to 0.15 part by weight, per 100 parts by weight of the toner. If the amount added of the fine particles of the acrylic polymer exceeds 1 part by weight, the developing characteristics are rather degraded by reduction of the flowability or formation of agglomerates of the fine particles of the acrylic polymer. If the amount added of the fine particles of the acrylic polymer is too small, the intended effects of the present invention can hardly be attained.

In the present invention, fine particles of silica can be added together with the fine particles of the acrylic polymer. By addition of the fine particles of silica, the flowability of the toner (composition) is further improved, and a good dispersion state of the fine particles of the acrylic polymer can be maintained, with the result that the developing properties, flowability and blocking resistance can be further improved. The fine particles of silica are preferably fine particles of hydrophobic silica. It is preferred that fine particles of silica having a primary particle diameter of 0.01 to 0.04 μm, especially 0.02 to 0.03 μm, be used. It also is preferred that the fine particles of silica be used in such an amount that the weight ratio of the fine particles of silica to the fine particles of the acrylic polymer is from 1/1 to 5/1, especially from 2.5/1 to 3.5/1. If the amount of the fine particles of silica is too small and below the above-mentioned range, the flowability of the entire composition and the maintenance of the dispersion state of the fine particles of the acrylic polymer are degraded. If the amount of the fine particles of silica exceeds the above-mentioned range, silica is likely to reduce the charge quantity of the toner, and it often happens that tailing is caused in the formed image or control of the toner concentration by a toner concentration sensor becomes difficult.

Toner particles used in the present invention are formed by dispersing additives such as a colorant into a binder resin as described below. Various polymers, for example, styrene type polymers, acrylic polymers, styrene-acrylic polymers, olefin polymers such as chlorinated polyethylene, polypropylene and ionomer, polyvinyl chloride, polyesters, polyamides, polyurethanes, epoxy resins, diallyl phthalate resins, silicone resins, ketone resins, polyvinyl butyral resins, phenolic resins, rosin-modified phenolic resins, xylene resins, rosin-modified maleic acid resins and rosinesters, can be used. Appropriate polymers are selected according to the fixing method and other required properties. In view of the pulverizability and easy controllability of the molecular weight distribution, it is preferred that a styrene polymer, an acrylic polymer and a styrene-acrylic polymer, especially a styrene-acrylic polymer, be used as the binder resin. It is preferred that the weight average molecular weight of the polymer as the binder resin be 30000 to 200000, especially 50000 to 150000. The foregoing polymers can be used singly or in the form of a mixture of two or more of them.

Of the foregoing polymers, a rosin ester, a rosin-modified phenolic resin, a rosin maleic acid resin, an epoxy resin, a polyester, a cellulose type polymer and a polyester resin are effective for the charging characteristics of the toner.

It is generally preferred that the softening point of the polymer be 50° to 200° C., especially 70° to 170° C.

If the toner is a pressure-fixing toner, a polymer which easiliy undergoes plastic deformation, for example, an olefin polymer such as polyethylene or polypropylene or a polyamide, is used. This polymer may contain other polymer such as polyvinyl acetate, an ethylene/vinyl acetate copolymer, hydrogenated polyethylene or a hydrogenated rosin ester, or an aliphatic, alicyclic or aromatic petroleum resin.

As the colorant to be dispersed in the above-mentioned binder resin, there can be mentioned carbon black, lamp black, chromium yellow, Hansa Yellow, Benzidine Yellow, Beslon Yellow, Quinoline Yellow, Permanet Orange GTR, Pyrazolone Orange, Vulcan Orange, Watchung Red, Permanent Red, Brilliant Carmine 3B, Brilliant Carmine 6B, Du pont Oil Red, Pyrazolone Red, Lithol Red, Rhodamine B Lake, Lake Red C, Rose Bengal, Aniline Blue, Ultramarine Blue, Calco Oil Blue, Methylene Blue chloride, Phtalocyanine Blue, Phtalocyanine Green and Malachite Green oxalate, and oil-soluble dyes such as C.I. Solvent Yellow 60, C.I. Solvent Red 27 and C.I. Solvent Blue 35. These colorants can be used singly or in the form of a mixture of two or more of them. The colorant is used in an amount enough to obtain a sufficient toner image density, for example, 1 to 30 parts by weight, preferably 2 to 20 parts by weight, per 100 parts by weight of the resin.

If the toner is a magnetic toner, a magnetic material can be added together with or instead of the colorant. A material having a magnetic property or a magnatizable material can be used as the magnetic material. For example, ferromagnetic metals and alloys such as iron, cobalt nickel and manganese, represented by ferrite and magnetite, and compounds containing these metals can be mentioned. The magnetic material has an average particles size of 0.1 to 1 μm, and at least one member selected from the foregoing materials is used in an amount of 5 to 70 parts by weight, preferably 20 to 50 parts by weight, per 100 parts by weight of the resin.

In order to control the charge of the toner, a charge-controlling agent can be added. For example, there can be mentioned oil-soluble dyes such as Oil Black and Spilon Black, metal soaps such as salts of naphthenic acid, salicylic acid, octylic acid, fatty acids and resin acids with metals such as magnanese, iron, cobalt, nickel, lead, zinc, cerium and calcium, metal-containing azo dyes, pyrimidine compounds and alkyl salicylate-metal chelates. The charge-controlling agent is preferably used in an amount of 0.1 to 5 parts by weight.

In order to prevent adhesion of the toner to the fixing roller, it is preferred that an offset-preventing agent, for example, a wax such as low-molecular-weight polypropylene, low-molecular-weight polyethylene or paraffin wax, a low-molecular-weight polymer of an olefin having at least 4 carbon atoms, a fatty acid amide or a silicone oil, be incorporated in an amount of 0.5 to 15 parts by weight per 100 parts by weight of the binder resin.

It is generally preferred that the toner should have a particle size of 1 to 30 μm, especially 5 to 25 μm.

The toner composition of the present invention can be valuably used either as a one-component developer or as a two-component type developer.

If the toner composition is used as the one-component type developer, a developer is formed by mixing the toner containing the above-mentioned magnetic material with the fine particles of the acrylic polymer, optionally with the fine particles of silica. If the toner composition is used as a two-components type developer, a mixture of the toner and the fine particles of the acrylic polymer, optionally with the fine particles of silica, is used in the state mixed with an uncovered carrier composed of glass beads, oxidized or unoxidized iron powder or ferrite, or a covered carrier formed by covering a magnetic material such as iron, cobalt or ferrite with a polymer such as an acrylic polymer, a fluorine resin type polymer or a polyester. The carrier generally has a particle size of 50 to 2000 μm. When a developer comprising the above-mentioned toner and carrier is used, the toner concentration is adjusted to 2 to 15% by weight. The toner composition constructed in the above-mentioned manner has sufficient durability and moisture resistance while it is actually used, and even in the case where the toner (composition) is frequently supplied from a hopper and the charge of the consumption of the toner is drastic as in case of continuous copying or high-speed copying, changes of the characteristics are very small, and the charging stability, cleaning property and flowability can be stably maintained at high levels and images having a high quality can be formed. Moreover, a minute amount of the dispersion stabilizer, such as a butadiene rubber, left adhering to the fine particles of the acrylic polymer gives a release property to the melt at the fixing step and effectively acts as an offset-preventing agent.

In the toner composition of the present invention, hydrophobic fine particles of an acrylic polymer obtained substantially by dispersion polymerization are dispersed in the state where the fine polymer particles cover the surfaces of toner particles uniformly and homogeneously, and therefore, excellent developing and cleaning properties are always exerted stably even if the copying environment is charged or the continuous copying is conducted for a long time. Moreover, the transportability and blocking resistance are improved.

The present invention will now be described in detail with reference to the following examples.

The synthesis of acrylic polymer particles will first be described.

SYNTHESIS EXAMPLE 1

In 800 g of n-heptane is dissolved 4 g of butadiene rubber, and 200 g of methyl methacrylate and 4 g of azobisisobutyronitrile were added into the solution. In a separable flask having an inner volume of 1 liter, the mixture was reacted at 70° C. with stirring at 150 rpm in a nitrogen current for 12 hours to complete the polymerization. The formed emulsion was cooled to 0° C. and allowed to stand still for 12 hours, whereby all of the formed polymer particles were precipitated. The supernatant was removed and the residue was dried under reduced pressure at room temperature. Agglomerates of the obtained resin were disintegrated by a jet mill to obtain a white powder. When the powder was observed by a transmission type electron microscope, it was found that the particles were completely disintegrated to primary particles and the particle size was 0.2 μm.

SYNTHESIS EXAMPLE 2

In 800 g of n-heptane was dissolved 4 g of isobutylene rubber, and 200 g of methyl acrylate and 4 g of azobisisobutyronitrill were added to the solution. In a separable flask having an inner volume of 1 liter, the mixture was reacted at 70° C. with stirring at 150 rpm in a nitrogen current for 12 hours to complete the polymerization. The formed emulsion was cooled to 0° C. and allowed to stand still for 12 hours, whereby all of the formed polymer particles were precipitated. The supernatant was removed and the residue was dried under reduced pressure at room temperature. Agglomerates of the obtained resin were disintegrated by a jet mill to obtain a white powder. When the powder was observed by a transmission type electron microscope, it was found that the particles were completely disintegrated to primary particles and the particle size was 0.3 μm.

SYNTHESIS EXAMPLE 3

In 800 g of n-hexane was dissolved 4 g of styrene-butadiene rubber, and 200 g of methyl methacrylate and 10 g of benzoyl peroxide were added to the solution. In a separable flask having an inner volume of 1 liter, the mixture was reacted at 70° C. with stirring at 150 rpm in a nitrogen current for 12 hours to complete the polymerization. The formed emulsion was cooled to 0° C. and allowed to stand still for 12 hours, whereby all of the formed polymer particles were precipitated. The supernatant was removed and the residue was dried under reduced pressure at room temperature. Agglomerates of the obtained resin were disintegrated by a jet mill to obtain a white powder. When the powder was observed by a transmission type electron microscope, it was found that the particles were completely disintegrated to primary particles and the particle size was 0.5 μm.

SYNTHESIS EXAMPLE 4

A separable flack having an inner volume of 1 liter was charged with 200 g of methyl methacrylate, 400 g of distilled water, 0.7 g of potassium persulfate and 0.5 g of polyvinyl alcohol, and the resultant mixture was reacted at 80° C. with stirring at 150 rpm in a nitrogen current for 5 hours to complete the polymerization. The formed emulsion was cooled to 0° C. and allowed to stand still for 10 hours, whereby all of the formed polymer particles were precipitated. The supernatant was removed and the residue was dried by using a hot air drier. Agglomerates of the obtained resin were disintegrated to obtain a white powder. When the powder was observed by a transmission type electron microscope, it was found that the particle size was 0.5μm.

The toner composition will now be described.

EXAMPLE 1

According to customary procedures, 100 parts by weight of a styrene/acrylic copolymer (having a weight average molecular weight of 120000 and Tg of 68° C.) as the binder resin was melt-kneaded with 10 parts by weight of carbon black as the colorant, 1 part by weight of a dye of the negative polarity as the charge-controlling agent and 1.5 parts by weight of low-molecular-weight polypropylene as the offset-preventing agent, and the kneaded mixture was cooled and pulverized to obtain a toner having an average particle size of 15 μm. To 100 parts by weight of the obtained toner particles were added 0.1 part by weight of the PMMA particles obtained in Synthesis Example 1 and 0.3 part by weight of hydrophobic silica having an average particle size of 16 μm (Aerosil R972 supplied by Nippon Aerosil) to obtain a toner composition. The toner composition was mixed with a ferrite carrier having a particle size of 100 μm so that the toner concentration was 4.5%. The copying test for obtaining 50000 copies was carried out under normal temperature and normal humidity conditions (temperature of 20° C. relative humidity of 60%) by using the obtained developer in a remodelled machine of a commercially available electrophotographic copying machine (Model DC-3285 supplied by Mita Kogyo). The obtained results are shown in Table 1.

EXAMPLE 2

A developer was prepared in the same manner as described in Example 1 except that 0.1 part by weight of the PMMA particles obtained in Synthesis Example 2 were used as the acrylic polymer particles, and by using this developer, the copying test was carried out in the same manner as described in Example 1. The obtained results are shown in Table 1.

EXAMPLE 3

A developer was prepared in the same manner as described in Example 1 except that 0.1 part by weight of the PMMA particles obtained in Synthesis Example 3 were used as the acrylic polymer particles, and by using this developer, the copying test was carried out in the same manner as described in Example 1. The obtained results are shown in Table 1.

COMPARATIVE EXAMPLE 1

The copying test was carried out in the same manner as described in Example 1 except that 0.1 part by weight of the PMMA particles obtained by soap-free polymerization in Synthesis Example 4 were used as the acrylic polymer particles. The obtained results are shown in Table 1.

EXAMPLE 4

According to customary procedures, 100 parts by weight of a styrene/acrylic copolymer (having a weight average molecular weight of 120000 and Tg of 68° C.) as the binder resin was melt-kneaded with 10 parts by weight of carbon black as the colorant, 1 part by weight of a dye of the negative polarity as the charge-controlling agent and 1.5 parts by weight of low-molecular-weight polypropylene as the offset-preventing agent, and the kneaded mixture was cooled and pulverized to obtain a toner having an average particle size of 15 μm. To 100 parts by weight of the obtained toner particles were added 0.05 part by weight of the PMMA particles obtained in Synthesis Example 1 and 0.2 part by weight of hydrophobic silica having an average particle size of 16 μm (Aerosil R972 supplied by Nippon Aerosil) to obtain a toner composition. The toner composition was mixed with a ferrite carrier having a particle size of 100 μm so that the toner concentration was 4.5%. The copying test for obtaining 50000 copies was carried out under high temperature and high humidity conditions (temperature of 35° C. and relative humidity of 80%) by using the obtained developer in a remodelled machine of a commercially available electrophotographic copying machine (Model DC-3285 supplied by Mita Kogyo).

EXAMPLE 5

The copying test was carried out in the same manner as described in Example 4 except that 0.15 part by weight of the PMMA particles obtained in Synthesis Example 3 were used as the acrylic polymer particles and 0.4 part by weight of hydrophobic silica having an average particle size of 16 μm (Aerosil R972 supplied by Nippon Aerosil) was used. The obtained results are shown in Table 1.

COMPARATIVE EXAMPLE 2

The copying operation was carried out in the same manner as described in Example 4 except that 0.1 part by weight of the PMMA particles obtained by the soap-free polymerization in Synthesis Example 4 were used as the acrylic polymer particles and 0.3 part by weight of hydrophobic silica having an average particle size of 16 μm (Aerosil R972 supplied by Nippon Aerosil) was used. The obtained results are shown in Table 1.

EXAMPLE 6

The copying test was carried out in the same manner as in Example 4 except that the amount added of the PMMA particles was changed to 0.15 parts by weight. The obtained results are shown in Table 1.

EXAMPLE 7

The copying test was carried out in the same manner as described in Example 4 except that the amount added of the hydrophobic silica was changed to 0.3 part by weight. The obtained results are shown in Table 1.

TABLE 1

| | Amount (part by weight) of Acrylic Polymer | Amount (part by weight) of Silica | Flowability | Scattering of Toner | Fogging of Image | Cleaning Property | Remarks |
|---|---|---|---|---|---|---|---|
| Example 1 | 0.1 | 0.3 | ○ | ○ | ○ | ○ | |
| Example 2 | 0.1 | 0.3 | ○ | ○ | ○ | ○ | |
| Example 3 | 0.1 | 0.3 | ○ | ○ | ○ | ○ | |
| Comparative Example 1 | 0.1 | 0.3 | Δ | Δ | Δ | Δ | |
| Example 4 | 0.05 | 0.2 | ○ | ○ | ○ | ○ | |
| Example 5 | 0.15 | 0.4 | Δ | ○ | ○ | ○ | |
| Comparative Example 2 | 0.1 | 0.3 | X | Δ | X | X | * |
| Example 6 | 0.15 | 0.2 | Δ | Δ | Δ | ○ | |
| Example 7 | 0.05 | 0.3 | ○ | Δ | Δ | ○ | ** |

*dropping of toner became impossible when 10000 copies were formed
**tailing was caused in solid colored portion With respect to the developers obtained in the examples and comparative examples, the blocking resistance in a developer vessel maintained at a high temperature and a high humidity was examined. It was found that in any of the developers obtained in the examples, blocking was hardly caused and partially formed agglomerates were easily disintegrated by pressing by the finger. However, in the developers obtained in the comparative examples, strong blocking was caused and agglomerates were not disintegrated by pressing by the finger.

In the column of "Flowability" in Table 1, mark "○" indicates that the transportability from the hopper and the flowability in the developing device were good, mark "Δ" indicates that the transportability from the hopper and the flowability in the developing device were relatively poor, and mark "X" indicates that the toner did not drop from the hopper and the development became impossible.

In the column of "Scattering of Toner", the results of naked eye examination of the contamination of the region below the developing zone and the back surface contamination of the copy are shown, and mark "○" indicates that scattering was not caused, mark "Δ" indicates that scattering is hardly caused, and mark "X" indicates that the back surface contamination was found in many copies.

In the column of "Cleaning Property" in Table 1, the results of the judgment of the cleaning property based on the image of the obtained copy are shown, and mark "○" indicates that the contamination of the image was not found, mark "Δ" indicates that the contamination of the image was sometimes found, and mark "×" indicates that the contamination of the image was frequently found.

From the results obtained in Examples 1 and 2 and Comparative Example 1, it is seen that a toner composition comprising acrylic polymer particles obtained by dispersion polymerization according to the present invention is highly improved in the copying property (printability) over a toner composition comprising acrylic polymer particles obtained by soap-free polymerization. From the results obtained in Examples 4 and 5 and Comparative Example 2, the degradation of performances in the toner composition of the present invention under high-temperature and high-humidity conditions is much smaller than in the conventional toner composition.

Furthermore, from the results shown in Examples 6 and 7, preferred amounts added of the acrylic polymer particles and silica particles can be easily inferred.

As is apparent from the foregoing description, according to the present invention, a uniform and homogeneous dispersion state of fine particles of an acrylic polymer can be stably maintained, and therefore, in the toner composition of the present invention, a good flowability is stably maintained and the cleaning property, charging stability and durability are highly improved, and sharp and clear copied images can be formed over a long period. Moreover, the storage stability of the developer (toner composition) is improved and blocking is not caused.

I claim:

1. A toner composition comprising a toner having electroscopic and fixing properties and fine particles of an acrylic polymer, wherein the fine particles of the acrylic polymer are hydrophobic spherical particles having a particle size of 0.05 to 1 μm, which are obtained by dispersion polymerization of an acrylic monomer in a non-aqueous medium.

2. A toner composition as set forth in claim 1, wherein the fine particles of the acrylic polymer are those obtained by dispersion-polymerizing an acrylic acid ester or a methacrylic acid ester in a saturated hydrocarbon solvent in the presence of a synthetic rubber or natural rubber as a dispersion stabilizer and an oil-soluble radical polymerization initiator.

3. A toner composition as set forth in claim 1, wherein the fine particles of the acrylic polymer are present in an amount of 0.01 to 1 part by weigh per 100 parts by weight of the toner.

4. A toner composition as set forth in claim 1, wherein the fine particles of the acrylic polymer are present in the state adhering to the peripheries of the toner particles.

5. A toner composition comprising a toner having electroscopic and fixing properties, fine particles of an acrylic polymer and fine particles of silica, wherein the fine particles of the acrylic polymer are hydrophobic spherical particles having a particle size of 0.05 to 1 μm, which are obtained by dispersion polymerization of an acrylic monomer in a non-aqueous medium.

6. A toner composition as set forth in claim 5, wherein the fine particles of the acrylic polymer are present in an amount of 0.01 to 1 part by weight per 100 parts by weight of the toner and the fine particles of silica are present in an amount of 1 to 5 parts by weight per part by weight of the fine particles of the acrylic polymer.

7. A toner composition as set forth in claim 5, wherein the fine particles of silica are composed of hydrophobic silica having a primary particle size of 0.01 to 0.04 μm.

8. A toner composition as set forth in claim 1, wherein the fine particles of the acrylic polymer are those obtained by dispersion polymerizing acrylic acid in n-hexane, in the presence of butadiene rubber as a dispersion stabilizer and azobisisobutyronitrile as the oil-soluble radical polymerization initiator.

9. A toner composition as set forth in claim 5, wherein the fine particles of the silica are present in an amount of 2.5 to 3.5 parts by weight per part by weight of the fine particles of the acrylic polymer.

* * * * *